US008529998B2

(12) United States Patent
Takeda et al.

(10) Patent No.: US 8,529,998 B2
(45) Date of Patent: Sep. 10, 2013

(54) METHOD FOR MANUFACTURING MOLTEN METAL PLATED STEEL STRIP

(75) Inventors: Genrato Takeda, Fukuyama (JP); Hideyuki Takahashi, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 478 days.

(21) Appl. No.: 12/227,206

(22) PCT Filed: Apr. 27, 2007

(86) PCT No.: PCT/JP2007/059541

§ 371 (c)(1),
(2), (4) Date: Nov. 10, 2008

(87) PCT Pub. No.: WO2007/132701

PCT Pub. Date: Nov. 22, 2007

(65) Prior Publication Data

US 2009/0159233 A1 Jun. 25, 2009

(30) Foreign Application Priority Data

May 12, 2006 (JP) ..... 2006-133265
May 12, 2006 (JP) ..... 2006-133284

(51) Int. Cl.
*B05D 1/18* (2006.01)
*C23C 2/20* (2006.01)

(52) U.S. Cl.
USPC ..... 427/349; 427/436; 427/434.2; 427/433

(58) Field of Classification Search
USPC ..... 427/435, 436
See application file for complete search history.

(56) References Cited

U.S. PATENT DOCUMENTS 5,254,166 A 10/1993 Tu
5,518,772 A * 5/1996 Andachi et al. ..... 427/349

FOREIGN PATENT DOCUMENTS

JP 55-051304 U 4/1980
JP 57-200558 U 12/1982
JP 63-153254 A 6/1988
JP 01-230758 A 9/1989
JP 04074857 A * 3/1992
JP 10-204599 A 8/1998

(Continued)

OTHER PUBLICATIONS

The International Preliminary Report on Patentability Written Opinion dated Dec. 10, 2008, issued in a counterpart International Application.

(Continued)

*Primary Examiner* — David Turocy
(74) *Attorney, Agent, or Firm* — Holtz, Holtz, Goodman & Chick, PC

(57) ABSTRACT

A gas wiping nozzle includes a primary nozzle portion and at least one secondary nozzle portion provided either or both above and below the primary nozzle portion. The secondary nozzle portion jets a gas in a direction tilted from the direction in which the primary nozzle portion jets the gas and at a lower flow rate. The gas wiping nozzle has a tip whose lower surface forms an angle of 60° or more with the steel strip. The gas jetting port of the secondary nozzle portion is displaced in the direction opposite to the steel strip at least 5 mm apart from the gas jetting port of the primary nozzle portion, and the secondary nozzle portion jets the gas so that the flow rate of the secondary gas jet comes to 10 m/s or more at the confluence with the primary gas jet from the primary nozzle portion.

5 Claims, 8 Drawing Sheets

(56) References Cited

FOREIGN PATENT DOCUMENTS

| | | | | |
|---|---|---|---|---|
| JP | 10204599 | A | * | 8/1998 |
| JP | 2000-219951 | A | | 8/2000 |
| JP | 2000219951 | A | * | 8/2000 |
| JP | 2002-348650 | A | | 12/2002 |
| JP | 2005-344178 | A | | 12/2005 |
| JP | 2007-031805 | A | | 2/2007 |

OTHER PUBLICATIONS

Extended European Search Report (EESR) dated Jun. 1, 2012 (in English) in counterpart European Application No. 12163116.2.

* cited by examiner

METHOD FOR MANUFACTURING MOLTEN METAL PLATED STEEL STRIP

This application is a U.S. National Phase Application under 35 USC 371 of International Application PCT/JP2007/059541 filed Apr. 27, 2007.

TECHNICAL FIELD

The present invention relates to a method for manufacturing a molten metal plated steel strip in which a gas is jetted from a gas wiping nozzle onto the surface of a steel strip continuously drawn up from a molten metal plating bath to control the amount of the plating on the surface of the steel strip.

BACKGROUND ART

In a general continuous molten metal plating process, gas wiping is performed as shown in FIG. 6. In the gas wiping, a gas is jetted from a gas wiping nozzles 21 opposing each other onto the surface of a steel strip X between the gas wiping nozzles 21 that has been immersed in a plating bath 20 containing a molten metal and then drawn up in the vertical direction from the plating bath 20. In FIG. 6, reference numeral 22 designates a sink roll, and reference numerals 23 and 24 designate support rolls. The gas wiping scrapes and removed the excess of the molten metal to control the amount of plating, and uniformizes the molten metal deposited on the surface of the steel strip in the width and the length direction. The gas wiping nozzle generally has a larger width than the width of the steel strip so as to cover the widths of various steel strips and the displacement in the width direction of the drawn steel strip, thus extending over the ends of the steel strip in the width direction.

In such gas wiping, the gas jet is disturbed by collision with the steel strip and causes splashes. The molten metal dropping below the steel strip splashes around. The splashes are attached onto the surface of the steel strip and degrade the quality of the surface of the plated steel strip.

In order to increase the production in a continuous steel strip process, the line speed of the steel strip can be increased. However, the increase in line speed increases the initial amount of the plating on the steel strip immediately after dipping the steel strip in the plating bath because of the viscosity of the molten metal. For controlling the amount of plating in a predetermined range by gas wiping in a continuous molten metal plating process, accordingly, the pressure of the gas jetted onto the surface of the steel strip from the gas wiping nozzles must be increased. This significantly increases splashes to impair the superior quality of the surface.

Accordingly, some methods are proposed to solve the problem. The methods use auxiliary nozzles (secondary nozzles) additionally provided above and below the gas wiping nozzle (primary nozzle) that mainly controls the amount of the molten metal deposited on the steel strip so that the secondary nozzles enhance the performance of the primary nozzle.

Patent Document 1 discloses a method that partially enhances the gas wiping performance in the width direction by providing auxiliary nozzles at the upper sides of the ends of the wiping nozzles to prevent edge overcoating, and by aligning the positions of the steel strip that are hit by jet gas from the auxiliary nozzles and jet gas from the wiping nozzle.

Patent Document 2 discloses a method that prevents the gas jet from a primary nozzle from diverging by jetting a gas from auxiliary nozzles (secondary nozzles) provided above and below the primary nozzle and capable of controlling the pressure independently for regions divided into at least three. The method thus stabilizes the gas flowing along the steel strip after hitting the steel strip.

Patent Document 3 discloses a method in which the primary nozzle and the secondary nozzle are divided by a partition plate whose end at the jetting port side has an acute angle, and the secondary nozzle is tilted 5° to 20° from the primary nozzle to increase the potential core. Thus, the controlability of the plating amount is enhanced to stabilize the gas jet, and consequently noises are reduced.

Patent Document 4 discloses a method in which the primary gas jet is isolated from the ambient air by use of flame as an isolation gas when the primary gas is jetted. By surrounding the primary gas jet by a high-temperature gas, the flow resistance of the primary gas jet is reduced. Consequently, the potential core is increased to enhance the hitting force.

Patent Document 1: Japanese Unexamined Patent Application Publication No. 63-153254

Patent Document 2: Japanese Unexamined Patent Application Publication No. 1-230758

Patent Document 3: Japanese Unexamined Patent Application Publication 10-204599

Patent Document 4: Japanese Unexamined Patent Application Publication 2002-348650

DISCLOSURE OF INVENTION

According to the research that the inventors of the present invention have conducted, however, the above cited known techniques have the following disadvantages.

The method of Patent Document 1 jets a gas from the auxiliary nozzles at a higher pressure than from the wiping nozzle to enhance the wiping performance at the edges of the steel strip. However, this method causes gases to be mixed violently with each other even though the positions to be hit by the gases are aligned, and thus many splashes occur. Consequently, the quality of the resulting product is unstable.

The method of Patent Document 2 uses three nozzles integrated into one body, and the tip of the integrated body has a longitudinal section having an increased outer angle. The increase of the outer angle makes the removal of excess plating difficult and increases splashes. Furthermore, the integration of a plurality of nozzles increases the total thickness of the jetting ports of the nozzles (width in the longitudinal direction of the steel strip) to affect the nozzle performance adversely. Patent Document 2 describes that the nozzle has an acute outer angle. However, the figure illustrating the nozzle shows the tip of the nozzle has a longitudinal section having an outer angle of about 120°. Patent Document 2 does not clearly show what the description means, or the reason for the description.

Accordingly, an object of the present invention is to solve the above-described problems and to provide a method for stably manufacturing a high-quality molten metal plated steel strip using a gas wiping nozzle to control the amount of plating, thereby appropriately preventing defects of the plating surface resulting from splashes even though the steel strip is transported at a high speed.

The manufacturing method of the present invention to solve the above-described problems is as follows:

[1] A method for manufacturing a molten metal plated steel strip in which a gas is jetted from a gas wiping nozzle onto the surface of a steel strip continuously drawn up from a molten metal plating bath to control the amount of plating on the surface of the steel strip. The method uses a gas wiping nozzle including a primary nozzle portion and at least one secondary nozzle portion provided either or both above and below the primary nozzle portion. The secondary nozzle portion jets the gas in a direction tilted from the direction in which the primary nozzle portion jets the gas. The secondary nozzle portion jets the gas at a lower flow rate than the primary nozzle portion. The gas wiping nozzle has a tip whose lower surface forms an angle of 60° or more with the steel strip.

[2] In the method for manufacturing a molten metal plated steel strip of [1], the tip of the gas wiping nozzle may have a longitudinal section having an outer angle of 60° or less.

[3] In the method for manufacturing a molten metal plated steel strip of [1] or [2], the primary nozzle portion includes a first nozzle member, and the secondary nozzle portion is defined by the first nozzle member and a second nozzle member disposed outside the first nozzle member. The end of the second nozzle member defining a gas jetting port of the secondary nozzle portion may have a thickness of 2 mm or less.

[4] In the method for manufacturing a molten metal plated steel strip of any one of [1] to [3], the sum of the thickness of the end of the first nozzle member defining a gas jetting port of the primary nozzle portion, the slit width of the gas jetting port of the secondary nozzle portion, and the thickness of the end of the second nozzle member defining the gas jetting port of the secondary nozzle portion may be 4 mm or less at either or both the upper side and the lower side of the gas wiping nozzle.

[5] A method for manufacturing a molten metal plated steel strip in which a gas is jetted from a gas wiping nozzle onto the surface of a steel strip continuously drawn up from a molten metal plating bath to control the amount of plating on the surface of the steel strip. The gas wiping nozzle includes a primary nozzle portion and at least one secondary nozzle portion provided either or both above and below the primary nozzle portion. The secondary nozzle portion jets the gas in a direction tilted from the direction in which the primary nozzle portion jets the gas so that the gas jet from the secondary nozzle portion meets the gas jet from the primary nozzle portion. The secondary nozzle portion has a gas jetting port displaced in the direction opposite to the steel strip at least 5 mm apart from the gas jetting port of the primary nozzle portion. The secondary nozzle portion jets the gas so that the flow rate of the gas jet from the secondary nozzle portion comes to 10 m/s or more at the confluence with the gas jet from the primary nozzle portion.

[6] In the method for manufacturing a molten metal plated steel strip of [5], the primary nozzle portion includes a first nozzle member, and the secondary nozzle portion is defined by the first nozzle member and a second nozzle member disposed outside the first nozzle member and has a gas jetting port through which the gas is jetted along the outer surface of the first nozzle member.

[7] In the method for manufacturing a molten metal plated steel strip of [5] or [6], the gas jetting port of the secondary nozzle portion may be displaced in the direction opposite to the steel strip 100 mm or less apart from the gas jetting port of the primary nozzle portion.

[8] In the method for manufacturing a molten metal plated steel strip of any one of [5] to [7], the end of the first nozzle member defining the gas jetting port of the primary nozzle portion may have a thickness of 2 mm or less.

According to the present invention, the hitting pressure of the gas jet is increased at the surface of the steel strip, and besides the pressure gradient of the hitting pressure distribution becomes steep in the line direction of the steel strip, by jetting a gas from the secondary nozzle portion at predetermined conditions. Accordingly, the performance of the gas jet in scraping the molten metal is enhanced. In addition, by controlling the angle between the lower surface of the gas wiping nozzle and the steel strip so as to have a sufficient space between them, the performance in scraping the plating can be further enhanced. Consequently, even if the steel strip is transported at a high speed, the molten metal can be scraped off without excessively increasing the pressure of the gas. Consequently, splashes can be reduced effectively. The enhancement of the scraping performance allows a lower pressure of jet gas and a larger distance between the gas wiping nozzle and the steel strip, in comparison with the known techniques. It accordingly becomes difficult for splashes to attach to the gas wiping nozzle. This is an advantage from the viewpoint of preventing the clogging of the nozzle. Accordingly, the present invention can stably manufacture a high-quality molten metal plated steel strip. Since the gas jetting port of the secondary nozzle portion is displaced in the direction opposite to the steel strip apart from the gas jetting port of the primary nozzle portion, in addition, the clogging of the nozzle can be prevented. Accordingly, a defect at the plating surface and nozzle clogging caused by splashes can be appropriately prevented even when the steel strip is transported at a high speed. Thus, a high-quality molten metal plated steel strip can be stably manufactured.

Figure 1:
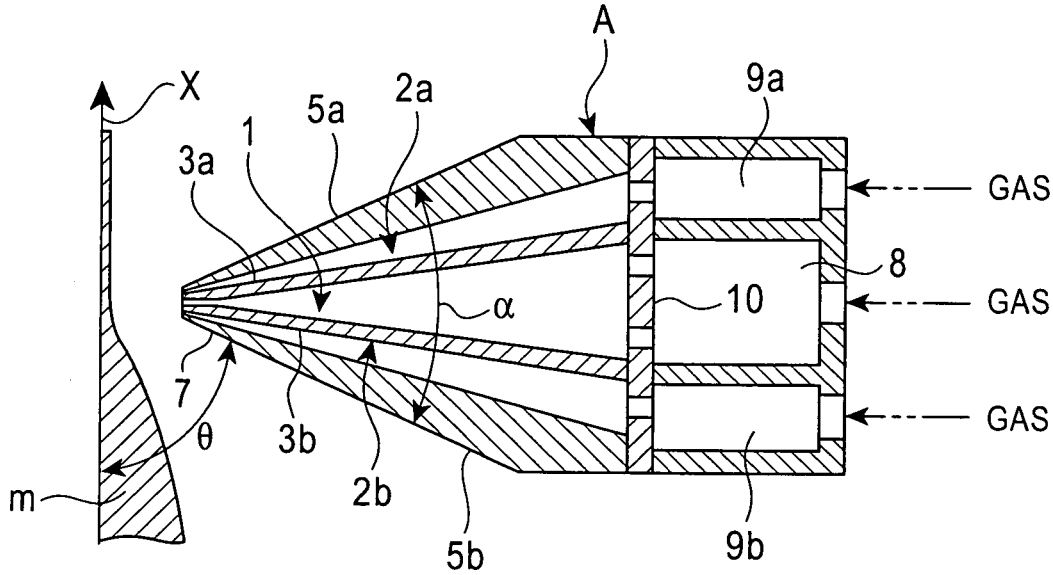
FIG. 1 is a longitudinal sectional view of a gas wiping nozzle according to an embodiment of the present invention.

| Reference Numerals<br>Reference numerals designate: | |
|---|---|
| 1 | primary nozzle portion |
| 2a, 2b | secondary nozzle portion |
| 3a, 3b | first nozzle member |
| 4, 6, 6a, 6b | gas jetting port |
| 5a, 5b | second gas nozzle member |
| 7 | lower surface |
| 8, 9a, 9b | pressure chamber |
| 10 | distributor |
| 11 | primary nozzle portion |
| 20a, 20b | secondary nozzle portion |
| p | confluence |

BEST MODES FOR CARRYING OUT THE INVENTION

Figure 2:
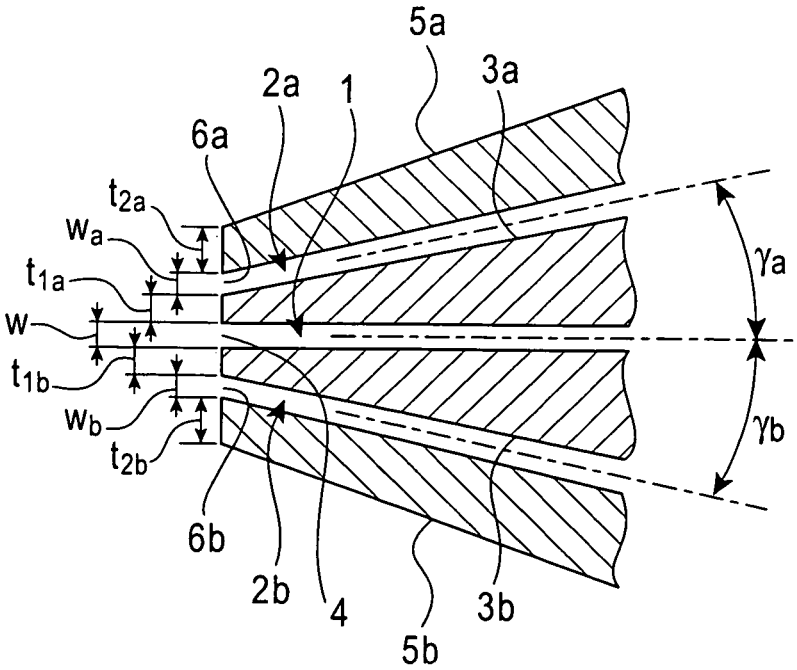
FIG. 2 is a fragmentary enlarged view of the tip of the gas wiping nozzle shown in FIG. 1.

FIGS. 1 and 2 show an embodiment of the present invention: FIG. 1 is a longitudinal sectional view of a gas wiping nozzle; and FIG. 2 is a fragmentary enlarged view of the tip of the nozzle shown in FIG. 1. In these figures, A designates the gas wiping nozzle, X designates a steel strip, m designates a molten metal deposited on the surface of the steel strip X.

The gas wiping nozzle A includes a primary nozzle portion 1 and secondary nozzle portions 2*a* and 2*b* provided above and below the primary nozzle portion 1. The primary nozzle portion 1 jets-a gas in a direction (normally in the direction substantially perpendicular to the surface of the steel strip), and the secondary nozzle portions 2*a* and 2*b* each jet a gas in a direction tilted from the direction in which the primary nozzle portion jets the gas (tilt angles $\gamma_a$ and $\gamma_b$ in FIG. 2). Thus, the gas jets from the secondary nozzle portions 2*a* and 2*b* (hereinafter referred to as secondary gas jets) meet the gas jet from the primary nozzle portion 1 (hereinafter referred to as primary gas jet).

The primary nozzle portion 1 includes an upper and a lower first nozzle member 3*a* and 3*b*. The gap between the ends of the first nozzle members 3*a* and 3*b* defines a gas jetting port 4 (nozzle slit). In addition, second nozzle members 5*a* and 5*b* are provided outside (above and below) the first nozzle members 3*a* and 3*b* of the primary nozzle portion 1. The second nozzle member 5*a* and the first nozzle member 3*a* define a secondary nozzle portion 2*a*, and the second nozzle member 5*b* and the first nozzle member 3*b* define a secondary nozzle portion 2*b*. The gap between the ends of the first nozzle member 3*a* and the second nozzle member 5*a* defines a gas jetting port 6*a* (nozzle slit), and the gap between the ends of the first nozzle member 3*b* and the second nozzle member 5*b* defines a gas jetting port 6*b* (nozzle slit). The nozzle constituted of the primary nozzle portion 1 and the secondary nozzle portions 2*a* and 2*b* has a tapered longitudinal section.

Figure 3:
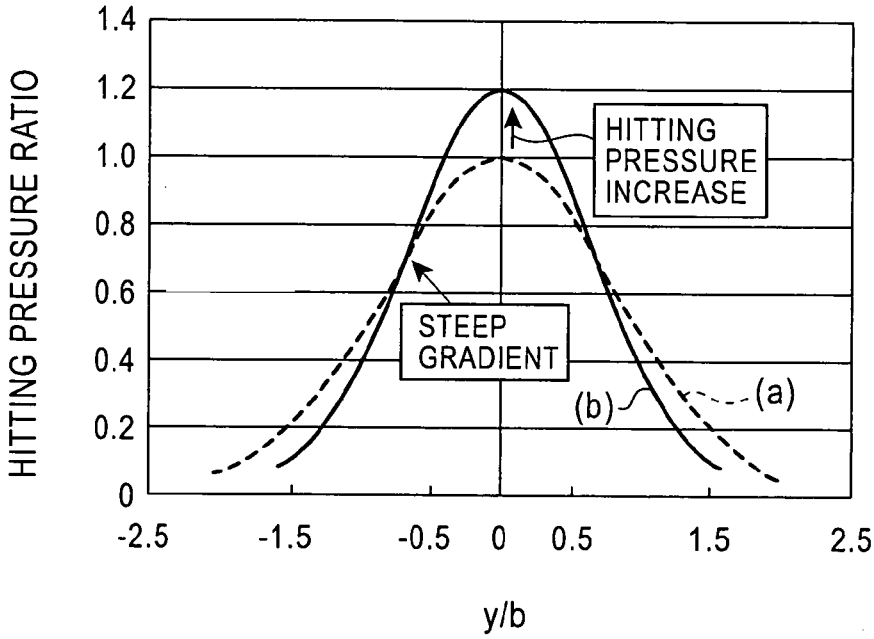
FIG. 3 is a plot showing the hitting pressure distribution curves of the gas wiping nozzle shown in FIG. 1 and a known single-nozzle type gas wiping nozzle, in comparison with each other.

In use of the gas wiping nozzle A, the primary gas jet from the primary nozzle portion 1 mainly scrapes the molten metal on the surface of the steel strip, and the secondary nozzle portions 2*a* and 2*b* discharge secondary gas jets at a lower speed than the primary nozzle portion. By discharging the secondary gas jets from the secondary nozzle portions 2*a* and 2*b*, the hitting pressure of the gas jet is increased at the surface of the steel strip, and the pressure gradient of the hitting pressure distribution becomes steep in the line direction of the steel strip. The gas jet enhances the performance in scraping the plating to the extent that the molten metal is scraped without excessively increasing the gas pressure even when the steel strip is transported at a high speed, thus preventing the occurrence of splashes effectively. FIG. 3 shows hitting pressure distributions to compare a known single-nozzle type gas wiping nozzle (not having secondary nozzle portions) with the gas wiping nozzle shown in FIG. 1: (a) represents the former hitting pressure distribution; and (b) represents the latter hitting pressure distribution. The horizontal axis of the slot represents y/b: b represents the slit width of the nozzle (slit gap); and y represents the distance from the center (y=0) of the gas jet. The vertical axis represents the hitting pressure ratio to the maximum hitting pressure (reference, 1.0) of hitting pressure distribution curve (a). y<0 Refers to a position below the center of the gas jet (molten metal plating bath side, and y>0 refers to a position above the center of the gas jet (opposite to the plating bath).

As shown in FIG. 3, hitting pressure distribution (b) of the gas wiping nozzle shown in FIG. 1 shows that the diffusion of the gas jet is reduced more than hitting pressure distribution (a) of the known single-type gas wiping nozzle and has steeper hitting pressure gradients with the hitting pressure increased. This suggests that the scraping (wiping) performance shown in curve (b) is higher than that shown in curve (a).

In the present invention, the angle θ formed between the lower surface 7 of the gas wiping nozzle A at least at the tip of the nozzle (preferably at least at the front half of the nozzle) and the steel strip X (hereinafter referred to as lower edge angle θ of the nozzle) is set at 60° or more. Preferably, the outer angle α of the longitudinal section of the tip of the gas wiping nozzle (angle formed between the upper surface of the second nozzle member 5*a* and the lower surface of the second nozzle member 5*b*, hereinafter referred to as outer angle α of the nozzle) is set at 60° or less. The reasons why those angles are limited as above will now be described.

In order to investigate what shape is the best for the gas wiping nozzle and how the gas wiping nozzle should be disposed, galvanized steel strips were prepared in a manufacturing line of galvanized steel strips under conditions: steel strip dimensions of 0.8 mm in thickness by 1000 mm in width; line speed of 150 m/min; gas wiping nozzle height from the galvanizing bath surface of 400 mm; galvanizing bath temperature of 460° C.; distance between the gas wiping nozzle and the steel strip of 8 mm.

The gas wiping nozzle used in the tests was of the type shown in FIG. 1 and includes secondary nozzle portions 2*a* and 2*b* provided above and below the primary nozzle portion 1. First, only the outer angle α of the nozzle was varied with the other conditions constant as follows: tilt angle $\gamma_a$ and $\gamma_b$ of the gas jetting direction of the secondary nozzle portions 2*a* and 2*b* from the gas jetting direction of the primary nozzle portion: 20°; slit width W (slit gap) of primary nozzle portion 1: 0.8 mm; slit widths $W_a$ and $W_b$ (slit gaps) of the secondary nozzles 2*a* and 2*b*: 0.8 mm; thicknesses $t_{1a}$ and $t_{1b}$ at the ends of the first nozzle members 3*a* and 3*b* of the primary nozzle 1: 0.2 mm; thicknesses $t_{2a}$ and $t_{2b}$ at the ends of the second nozzle members 5*a* and 5*b* of the secondary nozzles 2*a* and 2*b:* 2 mm; header pressure of the primary nozzle portion 1: 0.5 kgf/cm$^2$; header pressure of the upper secondary nozzle portion 2*a:* 0.2 kgf/cm$^2$; header pressure of the lower secondary nozzle portion 2*b:* 0.1 kgf/cm$^2$.

Figure 4:
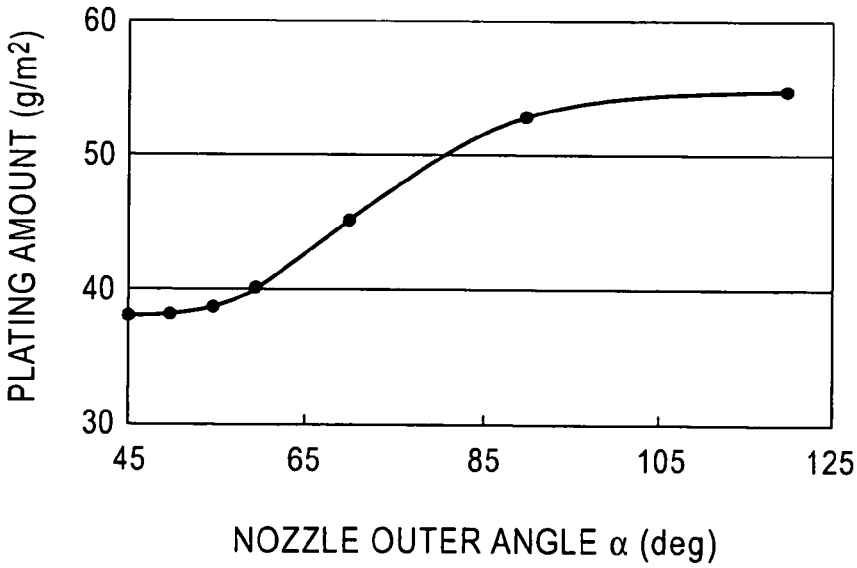
FIG. 4 is a plot showing the relationship between the outer angle $\alpha$ of a gas wiping nozzle having secondary nozzle portions above and below the primary nozzle portion and the gas wiping performance (amount of plating after gas wiping) in gas wiping of the surface of a steel strip with the gas wiping nozzle.

FIG. 4 shows the amount (remaining after gas wiping) of the plating deposited under the conditions above at nozzle outer angles α varied between 45° to 120°. In the tests, the primary nozzle portion 1 jetted the gas in the direction substantially perpendicular to the surface of the steel strip. FIG. 4 shows that as the outer angle α of the nozzle is increased, the plating amount (amount of plating remaining after gas wiping) is increased even if the gas is jetted at the same pressure. Accordingly, it is preferable that the outer angle α of the nozzle is 60° or less, and more preferably 50° or less.

Why the results shown in FIG. 4 had been obtained was investigated in detail. As a result, the following findings were obtained. A gas wiping nozzle having an obtuse outer angle α reduces the space between the steel strip X and the gas wiping nozzle A. Consequently, the gas jetted from the gas wiping nozzle A hits the steel strip X and then flows closer to the gas wiping nozzle. Accordingly, the gas flowing along the steel strip X is reduced. Thus, the initial amount of molten metal deposited on the steel strip X after being drawn from the plating bath is increased, and accordingly the removal of excess plating becomes difficult. It was also found that the increase of the amount of initial deposition easily causes splashes.

It is therefore considered that the gas wiping performance largely depends on the outer angle α of the nozzle, particularly on the angle at the lower side (plating bath side). Then, the effect on the plating amount (remaining after gas wiping) of changing the member 5*b* defining the lower portion of the nozzle to vary the lower edge angle θ of the nozzle was investigated under conditions that the tilt angle γa of the gas jetting direction of the upper secondary nozzle portion 2*a* from the gas jetting direction of the primary nozzle portion 1 was set at 20° and that the tilt angle γb of the gas jetting direction from the lower secondary nozzle portion 2*a* was set at 15°. The line conditions and the gas pressures were the same as above. The lower edge angle θ of the nozzle was varied to 30°, 45°, 60°, and 72° (outer angle α of the nozzle was varied to 85°, 70°, 55°, and 43° respectively). For a referential example, a test was performed at a lower edge angle θ of 72° and at an outer angle α of 70°.

Figure 5:
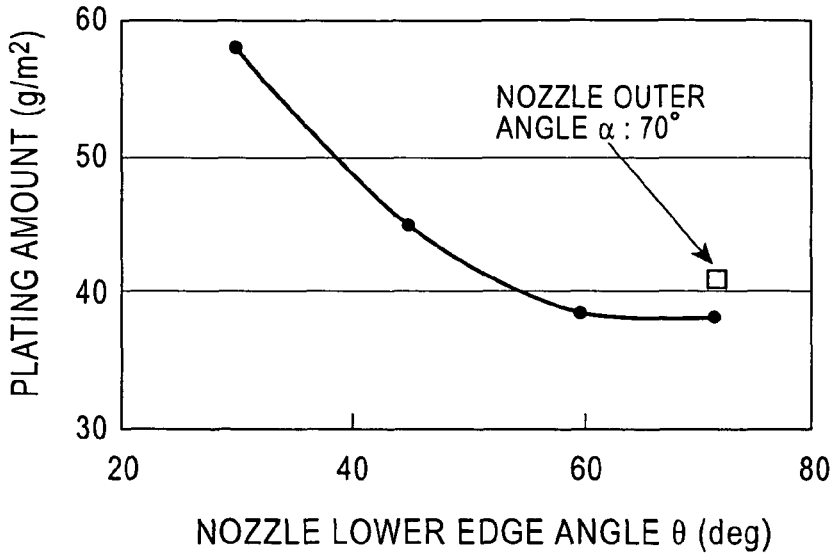
FIG. 5 is a plot showing the relationship between the lower edge angle $\theta$ of the gas wiping nozzle and the gas wiping performance (amount of plating after gas wiping) in gas wiping of the surface of a steel strip with the gas wiping nozzle having secondary nozzle portions above and below the primary nozzle portion.
Figure 6:
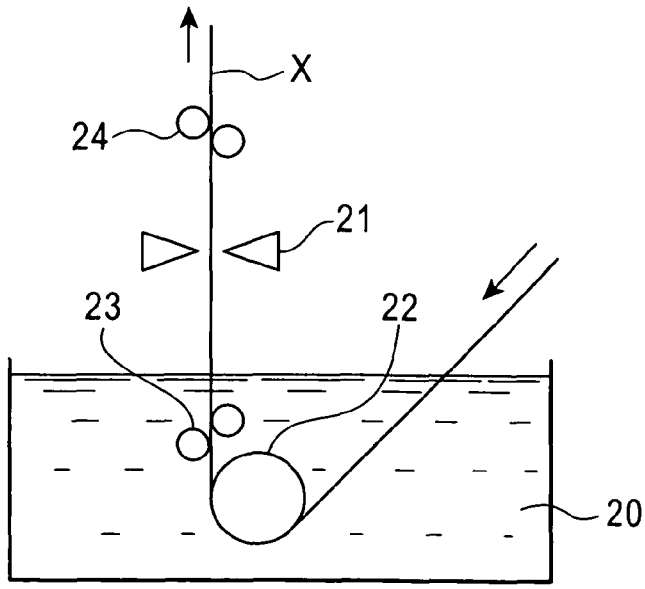
FIG. 6 is a schematic representation of a method for plating a steel strip with a molten metal.

The results are shown in FIG. 5. FIG. 5 shows that the plating amount was large (meaning that the gas wiping performance was low) at lower edge angles θ in the range of 30° to 45° while the plating amount was constant and hence independent of the lower edge angle θ of the nozzle at lower edge angles θ of 600 or more. When the outer angle α was 70°, the plating amount was slightly increased even at a lower edge angle θ of 72°, but was lower than that at an outer angle α of 70° shown in FIG. 4. This means that by increasing the lower edge angle θ of the nozzle, excess plating can be easily removed even at the same outer angle α.

Accordingly, the lower edge angle θ of the nozzle is set at 60° or more, and preferably the outer angle α of the nozzle is set at 60° or less, in the present invention.

Next, the effect of the thicknesses of the nozzle members at the end of the nozzle (gas jetting port) was investigated. As a result, it was found that when the thickness of the nozzle wall at the end was large, the pressure around the end was reduced to diffuse the gas jet, consequently degrading the gas wiping performance.

This test was performed under the same line conditions, and the shape and position of the gas wiping nozzle A were as follows: tilt angle $\gamma_a$ and $\gamma_b$ of the gas jetting direction of the secondary nozzle portions 2*a* and 2*b* from the gas jetting direction of the primary nozzle portion: 20°; outer angle α of the nozzle: 50°; lower edge angle θ of the nozzle: 65°; header pressure of the primary nozzle portion 1: 0.5 kgf/cm$^2$; header pressure of the upper secondary nozzle portion 2*a:* 0.2 kgf/cm$^2$; header pressure of the lower secondary nozzle portion 2*b:* 0.1 kgf/cm$^2$.

Other conditions of the gas wiping nozzle A and the plating amount were shown in Table 1. Table 1 shows that although these conditions do not affect the gas wiping performance more than the outer angle α and the lower edge angle θ of the nozzle, the gas wiping performance was degraded when the thicknesses $t_{1a}$ and $t_{1b}$ at the ends of the first nozzle members 3*a* and 3*b* defining the gas jetting port 4 of the primary nozzle portion 1 and the thicknesses $t_{2a}$ and $t_{2b}$ at the ends of the second nozzle members 5*a* and 5*b* defining the gas jetting ports 6*a* and 6*b* of the secondary nozzle portions 2*a* and 2*b* were each increased. Accordingly, it is preferable the thicknesses of the second nozzle members 5*a* and 5*b* defining the gas jetting ports 6*a* and 6*b* of the secondary nozzle portions 2*a* and 2*b* be each set at 2 mm or less at the ends. From the same viewpoint, it is preferable that the sum of the thickness $t_{1a}$ at the end of the first nozzle member 3*a* defining the gas jetting port 4 of the primary nozzle portion 1, the slit width $w_a$ of the gas jetting port 6*a* of the secondary nozzle portion 2*a*, and the thickness at the end of the second nozzle member 5*a* defining the gas jetting port 6*a* of the secondary nozzle portion 2*a*, and the sum of the thickness $t_1$ at the end of the first nozzle member 3*b* defining the gas jetting port 4 of the primary nozzle portion 1, the slit width $w_b$ of the gas jetting port 6*b* of the secondary nozzle portion 2*b*, and the thickness at the end of the second nozzle member 5*b* defining the gas jetting port 6*b* of the secondary nozzle portion 2*b* are each 4 mm or less.

TABLE 1

| No. | Thickness of first nozzle member end (mm) | Slit width of secondary nozzle portion (mm) | Thickness of second nozzle member end (mm) | Half lip thickness (mm) *1 | Plating amount (g/m$^2$) |
|---|---|---|---|---|---|
| 1 | 0.2 | 0.8 | 1.5 | 2.5 | 38 |
| 2 | 0.2 | 0.8 | 2.0 | 3.0 | 38 |
| 3 | 0.2 | 0.8 | 2.5 | 3.5 | 43 |
| 4 | 0.2 | 1.6 | 2.5 | 4.3 | 45 |
| 5 | 0.2 | 2.0 | 2.0 | 4.2 | 41 |
| 6 | 0.2 | 2.0 | 4.0 | 6.2 | 48 |

*1 (Thickness of first nozzle member end) + (Slit width of secondary nozzle portion) + (Thickness of second nozzle member end)

The other parts of the structure shown in FIG. 1 will now be described. In order to arbitrarily adjust the pressures of gas jets from the primary nozzle portion 1 and the secondary nozzle portions 2*a* and 2*b*, the primary nozzle portion 1 and the secondary nozzle portions 2*a* and 2*b* have their respective pressure chambers 8, 9*a*, and 9*b*. Streams of a gas are delivered to the pressure chambers 8, 9*a*, and 9*b* at pressures independently controlled. The gas delivered to the pressure chambers 8, 9*a*, and 9*b* passes through the distributor 10 to flow into the primary nozzle portion 1 and the secondary nozzle portions 2*a* and 2*b*.

The slit widths (slit gaps) of the gas jetting ports 4, 6*a*, and 6*b* of the primary nozzle portion 1 and the secondary nozzle portions 2*a* and 2*b* are not particularly limited. In general, the gas jetting port 4 has a slit width W of about 0.5 to 2 mm, and the gas jetting ports 6*a* and 6*b* have slit widths $W_a$ and $W_b$ of about 0.1 to 2.5 mm. The tilt angles $\gamma_a$ and $\gamma_b$ of the gas jetting direction of the secondary nozzle portions 2*a* and 2*b* from the gas jetting direction of the primary nozzle portion 1 are not also particularly limited as long as the outer angle $\alpha$ of the nozzle is in the predetermined range, and are preferably about 15° to 45°.

The gas wiping nozzle A used in the present invention may have a single secondary nozzle 2 above or below the primary nozzle portion 1.

When the secondary nozzles 2*a* and 2*b* are provided above and below the primary nozzle portion 1, as shown in FIG. 1, the tilt angles $\gamma_a$ and $\gamma_b$ of the gas jetting direction of the secondary nozzle portions 2*a* and 2*b* from the gas jetting direction of the primary nozzle portion 1*b* may be different from each other.

In the present invention, a gas is jetted onto the surface of the steel strip X continuously drawing up from the molten metal plating bath from a gas wiping nozzle A satisfying the above-described requirements (structure, shape, and positioning) so as to scrape the molten metal on the surface of the steel strip, thus controlling the amount of plating.

Figure 10:
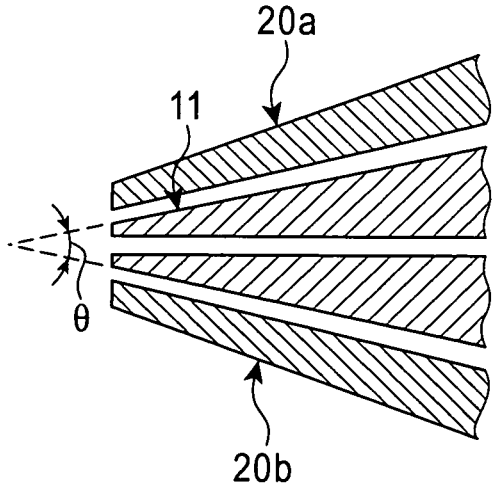
FIG. 10 is a longitudinal sectional view of a referential gas wiping nozzle having secondary nozzle portions above and below the primary nozzle portion.

In the method using the gas wiping nozzle as shown in FIG. 10, however, a plurality of nozzle slits (of primary nozzle and secondary nozzles) are present very close to the surface of the steel strip. Accordingly, the nozzle is liable to clog and can be unsuitable in practice. In the present invention, accordingly, the gas jetting port of the secondary nozzle portion is displaced in the direction opposite to the steel strip so as to have a predetermined distance from the gas jetting port of the primary nozzle portion, thereby preventing the clogging of the nozzle, and besides controlling the flow rate of the gas jet from the secondary nozzle portion (hereinafter referred to as secondary gas jet). The gas jet from the primary nozzle portion (hereinafter referred to as primary gas jet) is thus prevented from diffusing, so that the pressure gradient of the hitting pressure distribution curve becomes steep as shown in (b) of FIG. 3. In addition, the scraping performance is enhanced by increasing the hitting pressure, and thus splashes are reduced without excessively increasing the gas pressure.

There is substantially no difference in effect between the secondary gas jets from the secondary nozzle portions provided above and below the primary nozzle portion. Therefore, the secondary nozzle portion may be disposed either above or below the primary nozzle portion in the present invention, or may be disposed both above and below the primary nozzle portion.

The details of the manufacturing method of the present invention and its preferred embodiments will now be described.

The gas wiping nozzle used in the present invention includes a primary nozzle portion and at least one secondary nozzle portion provided either or both above and below the primary nozzle portion. The secondary nozzle portion jets a gas in a direction tilted from the direction in which the primary nozzle portion jets the gas. Thus, the gas jet from the secondary nozzle portion meets the gas jet from the primary nozzle portion. The gas is thus jetted from the gas wiping nozzle onto the surface of the steel strip continuously drawn up from a molten metal plating bath, thereby controlling the amount of plating on the surface of the steel strip.

In the manufacturing method of the present invention, the gas jetting port of the secondary nozzle portion is displaced in a direction opposite to the steel strip 5 mm or more apart from the gas jetting port of the primary nozzle portion. In addition, the secondary nozzle portion discharges the gas jet so that the flow rate of the gas jet comes to 10 m/s or more at the confluence with the gas jet discharged from the primary nozzle portion.

Figure 7:
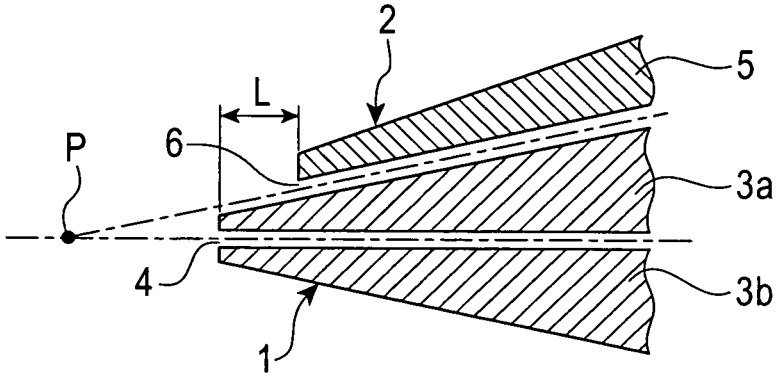
FIG. 7 is a longitudinal sectional view of a gas wiping nozzle according to an embodiment of the present invention.

FIG. 7 is a longitudinal sectional view of the gas wiping nozzle used in the present invention, showing an embodiment of the nozzle. The gas wiping nozzle includes a primary nozzle portion 1 and a secondary nozzle portion 2 provided above the primary nozzle portion 1. The secondary nozzle portion 2 jets a gas in a direction tilted from the direction (normally, direction perpendicular to the surface of the steel strip) in which the primary nozzle portion 1 jets the gas, so that the gas jet from the secondary nozzle portion 2 meets the gas jet from the primary nozzle portion 1. The primary nozzle portion 1 includes an upper and a lower first nozzle member 3*a* and 3*b* (first nozzle members). The gap between the ends of the first nozzle members 3*a* and 3*b* defines a gas jetting port 4 (nozzle slit). A second nozzle member 5 is provided outside (above) the first nozzle member 3*a* of the primary nozzle portion 1. The second nozzle member 5 and the first nozzle member 3*a* define a secondary nozzle portion 2*a*. The gap between the ends of the first nozzle member 3*a* and the second nozzle member 5 defines a gas jetting port 6 (nozzle slit) through which the gas is jetted along the outer surface of the first nozzle member 3*a*.

The gas jetting port 6 of the secondary nozzle portion 2 is displaced in the direction opposite to the steel strip at least 5 mm (in the figure, L: displacement) apart from the gas jetting port 4 of the primary nozzle portion 1. Consequently, splashes of the molten metal are appropriately prevented from clogging the secondary nozzle 2. If the displacement L of the gas jetting port 6 of the secondary nozzle portion 2 from the gas jetting port 4 of the primary nozzle portion 1 is less than 5 mm, the nozzle clogging cannot sufficiently be prevented. Preferably, the displacement L is set to at least 10 mm.

On the other hand, an excessively large displacement L of the gas jetting port 6 of the secondary nozzle portion 2 from the gas jetting port 4 of the primary nozzle portion 1 is undesirable. If the displacement L is excessively large, a large amount of gas is required, and the effect of the secondary gas jet from the secondary nozzle portion 2 of enhancing the performance in scraping the plating is reduced. It is generally known that gas jet flows along the surface of a wall (Coanda effect). If the gas jet is rapidly turned or is allowed to flow a long distance, the gas jet gradually comes apart from the wall surface or is diffused. In order to prevent these phenomena, a large amount of gas is required. When the displacement L of the gas jetting port 6 of the secondary nozzle portion 2 from the gas jetting port 4 of the primary nozzle portion is about 100 mm or less, the Coanda effect allows the gas jet to flow in contact with the outer surface of the first nozzle member 3*a* along the surface, and thus the secondary nozzle 2 efficiently produces the secondary gas jet. However, a displacement L of more than 100 mm diffuses the gas jet, consequently requiring a large amount of gas and reducing the effect of the secondary gas jet from the secondary nozzle of enhancing the performance in scraping the plating. The displacement L is preferably 100 mm or less, and desirably 50 mm or less.

Preferably, the first nozzle members 3*a* and 3*b* do not have an excessively steep angle so that the separation of the secondary gas jet can be prevented as much as possible.

In the manufacturing method of the invention, the secondary nozzle portion 2 jets the gas so that the flow rate of the secondary gas jet from the secondary nozzle portion 2 comes to 10 m/s or more at the confluence p with the gas jet from the primary nozzle portion 1. If the flow rate of the secondary gas jet is less than 10 m/s at the confluence p, the secondary gas jet does not sufficiently produce the effect of preventing the primary gas jet from diffusing, accordingly reducing the effect of enhancing the performance in scraping the plating. The flow rate of the secondary gas jet is preferably 20 m/s or more at the confluence p.

For the control of the flow rate of the secondary gas jet at the confluence p, the relationship between the header pressure and the flow rate of the secondary gas jet at a position corresponding to the confluence p in practice is obtained in advance, and then the header pressure is controlled.

Figure 8:
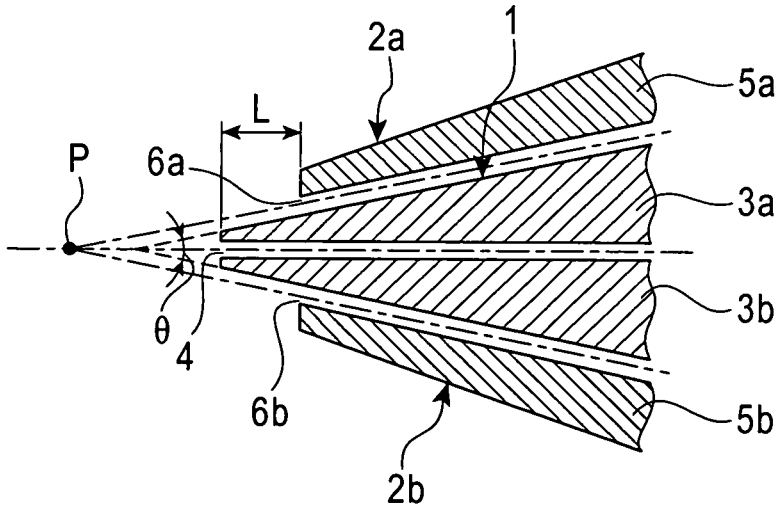
FIG. 8 is a longitudinal sectional view of a gas wiping nozzle according to another embodiment of the present invention.

FIG. 8 is a longitudinal sectional view of a gas wiping nozzle according to another embodiment of the invention. The gas wiping nozzle includes a primary nozzle portion 1 and secondary nozzle portions 2*a* and 2*b* provided above and below the primary nozzle portion 1. The secondary nozzle portions 2*a* and 2*b* jet a gas in directions tilted from the direction (normally, direction perpendicular to the surface of the steel strip) in which the primary nozzle portion 1 jets the gas, so that the gas jets from the secondary nozzle portions 2*a* and 2*b* meet the gas jet from the primary nozzle portion 1. The primary nozzle portion 1 has the same structure as the structure shown in FIG. 7. Second nozzle members 5*a* and 5*b* (second nozzle members) are disposed outside (above and below) first nozzle members 3*a* and 3*b* (first nozzle members) constituting the primary nozzle portion 1. The second nozzle members 5*a* and 5*b* and the first nozzle members 3*a* and 3*b* define the secondary nozzle portions 2*a* and 2*b*. The ends of the secondary nozzle members 5*a* and 5*b* and the first nozzle member 3*a* and 3*b* define gas jetting ports 6*a* and 6*b* (nozzle slits) respectively through which the gas is jetted along the outer surfaces of the first nozzle members 3*a* and 3*b*.

The gas jetting ports 6*a* and 6*b* of the secondary nozzle portions 2*a* and 2*b* are displaced in the direction opposite to the steel strip at least 5 mm (in the figure, L: displacement), preferably at least 10 mm, apart from the gas jetting port 4 of the primary nozzle portion 1. Consequently, splashes of the molten metal are appropriately prevented from clogging the secondary nozzle portions 2*a* and 2*b*. The displacement L is preferably 100 mm or less, and desirably 50 mm or less. In addition, the secondary nozzle portions 2 jet the gas so that the flow rate of the secondary gas jets come to 10 m/s or more, preferably 20 m/s or more, at the confluence p with the primary gas jet from the primary nozzle portion 1. The displacement L and the flow rate of the secondary gas jet are thus limited because of the same reasons as in the embodiment shown in FIG. 7.

Figure 9:
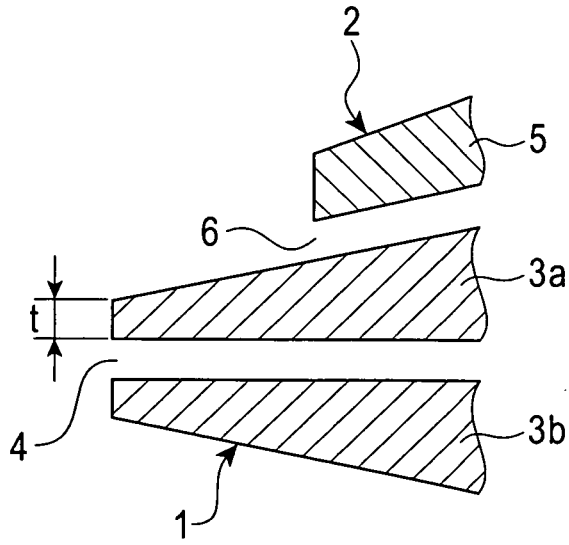
FIG. 9 is a fragmentary enlarged view of the tip of the gas wiping nozzle shown in FIG. 7.

FIG. 9 is a fragmentary enlarged view of the tip of the nozzle shown in FIG. 7. In the gas wiping nozzle used in the present invention, the ends of the first nozzle members 3*a* and 3*b* defining the gas jetting port 4 of the primary nozzle portion 1 preferably have a thickness t of 2 mm or less, and desirably 1 mm or less. In general, if the thickness t of the ends of the first nozzle members 3*a* and 3*b* is more than 2 mm, the confluence of the primary gas jet and the secondary gas jets become distant from the tip of the nozzle, depending on the tilt angle of the gas jetting direction of the secondary nozzles from the gas jetting direction of the primary nozzle portion. Consequently, the secondary gas jet cannot sufficiently prevent the primary gas jet from diffusing, or sufficiently scrape off the plating.

In general, the gas wiping nozzle is subjected to surface treatment, such as Cr plating. For this surface treatment, the corners are round-chamfered into a shape defined by an ark having a radius R. In this instance, preferably, the inner and outer corners of the ends of the first nozzle members 3*a* and 3*b* are chamfered so that the radiuses R are small as much as possible, and particularly preferably R0.5 or less, from the viewpoint of sufficiently producing the effect of the secondary gas jet of preventing the primary gas jet from diffusing.

EXAMPLES

In a manufacturing line of a galvanized steel strip, various types of gas wiping nozzles were provided at gas wiping positions over a galvanizing bath, and a galvanized steel strip of 1.0 mm in thickness by 1200 mm in width was experimentally produced. The process was conducted under the following conditions (throughout the tests): gas wiping nozzle height from the galvanizing bath surface: 400 mm; galvanizing bath temperature: 460° C.; primary gas jet pressure of the gas wiping nozzle: 0.65 kgf/cm$^2$; distance between the gas wiping nozzle and the steel strip: 8 mm; and steel strip line speed: 120 mpm. The plating amount and the occurrence (times/hour) of nozzle clogging were examined for each test. FIGS. 11 to 15 show the results. In the tests, a type of gas wiping nozzle having secondary nozzles above and below the primary nozzle portion as shown in FIGS. 8 and 10 was used. In the gas wiping nozzles, the nozzle slit width of the primary nozzle portion was 1 mm; the slit width of the secondary nozzle portion was 1 mm; and outer angle of the primary nozzle portion was 40° (angle θ shown in FIGS. 8 and 10).

Figure 11:
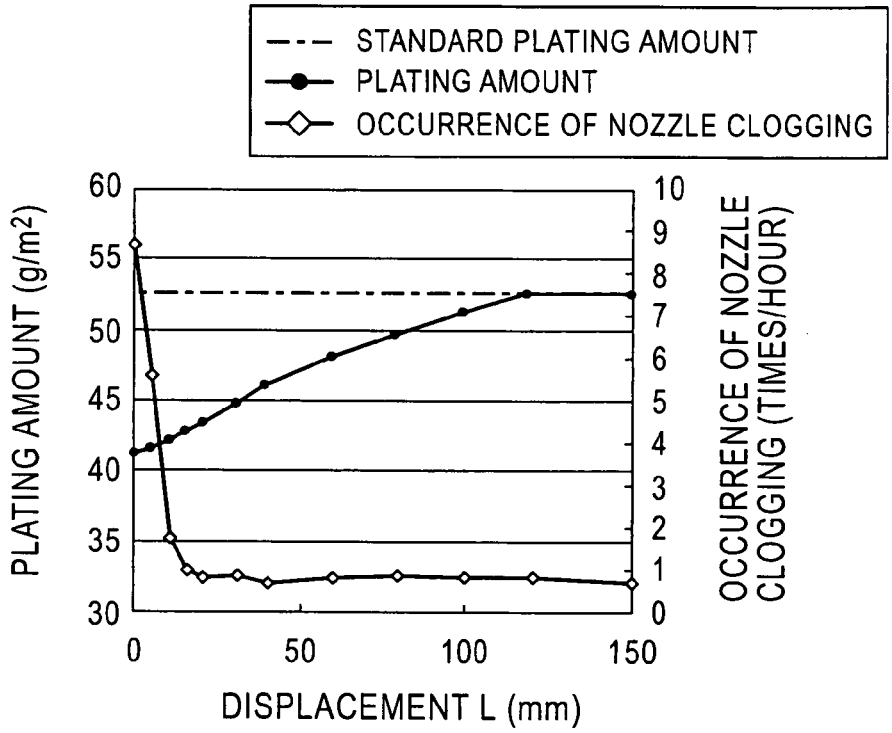
FIG. 11 is a plot showing the relationships between the displacement L and the plating amount and between the displacement L and the occurrence of nozzle clogging obtained from manufacture tests using the type of gas wiping nozzle shown in FIG. 10 and the type shown in FIG. 8 having different displacements L.
Figure 12:
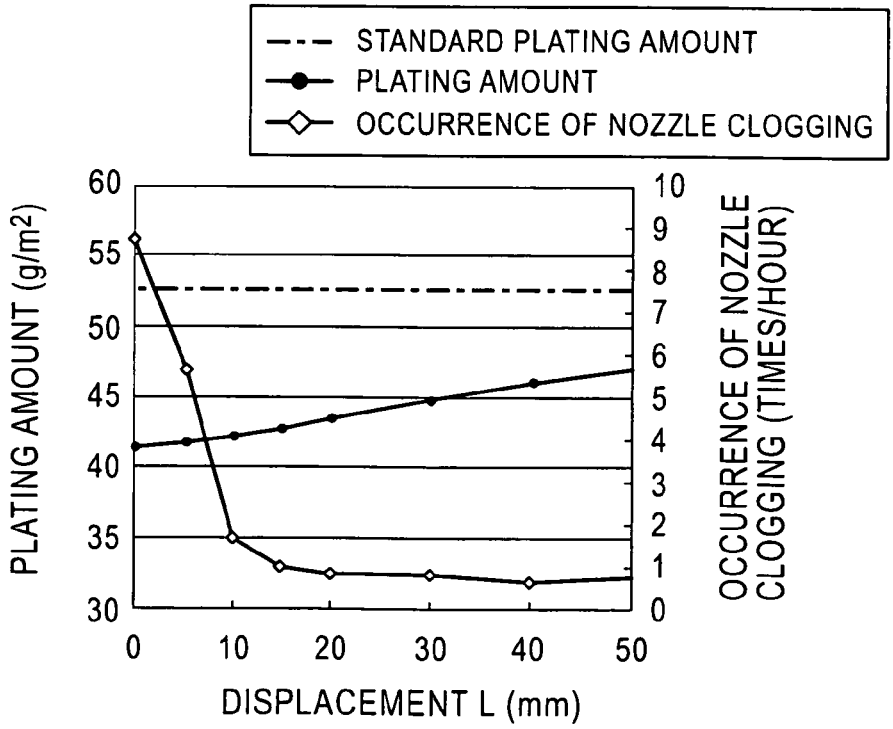
FIG. 12 is an enlarged view of a part (region having small displacement L) of the plot shown in FIG. 11.

FIG. 11 shows the relationships between the displacement L and the plating amount and between the displacement L and the occurrence of nozzle clogging when the gas jetting port of the secondary nozzle portion is displaced in the direction opposite to the steel strip from the gas jetting port of the primary nozzle portion. FIG. 12 shows part of FIG. 11 (region having small displacement L) in an enlarged view. In the tests, gas wiping nozzles were of type shown in FIG. 10 (displacement L=0) and of type shown in FIG. 8 having different displacements L. In either type, the end of the first nozzle member of the primary nozzle portion had a thickness t of 1 mm, and the flow rate of the secondary gas jet at the confluence p with the primary gas jet from the primary nozzle portion was set at 20 m/s. The standard plating amount shown in FIGS. 11 and 12 refers to the plating amount when gas wiping is performed only by the gas jet discharged from the primary nozzle portion without using gas get from the secondary nozzle portion. FIGS. 11 and 12 show that when the displacement L is 5 mm or more, particularly 10 mm or more, the occurrence of nozzle clogging is significantly reduced. When the displacement L is increased to more than 100 mm, in contrast, the effect of the secondary gas jet from the secondary nozzle portion of scraping the plating is reduced, and the plating amount comes close to the standard plating amount. Particularly when the displacement L is 50 mm or less, the secondary gas jet from the secondary nozzle portion can scrape the plating effectively.

Figure 13:
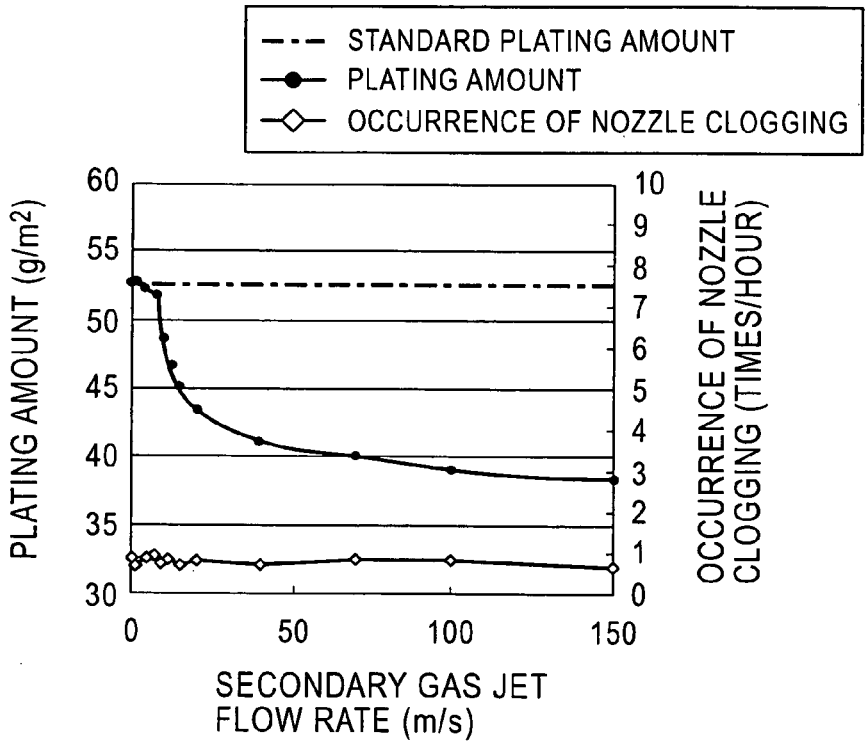
FIG. 13 is a plot showing the relationships between the flow rate of the secondary gas jet at the confluence p with the primary gas jet and the plating amount and between the flow rate of the secondary gas jet at the confluence p and the occurrence of nozzle clogging, obtained from manufacture tests using the type of gas wiping nozzle shown in FIG. 8.
Figure 14:
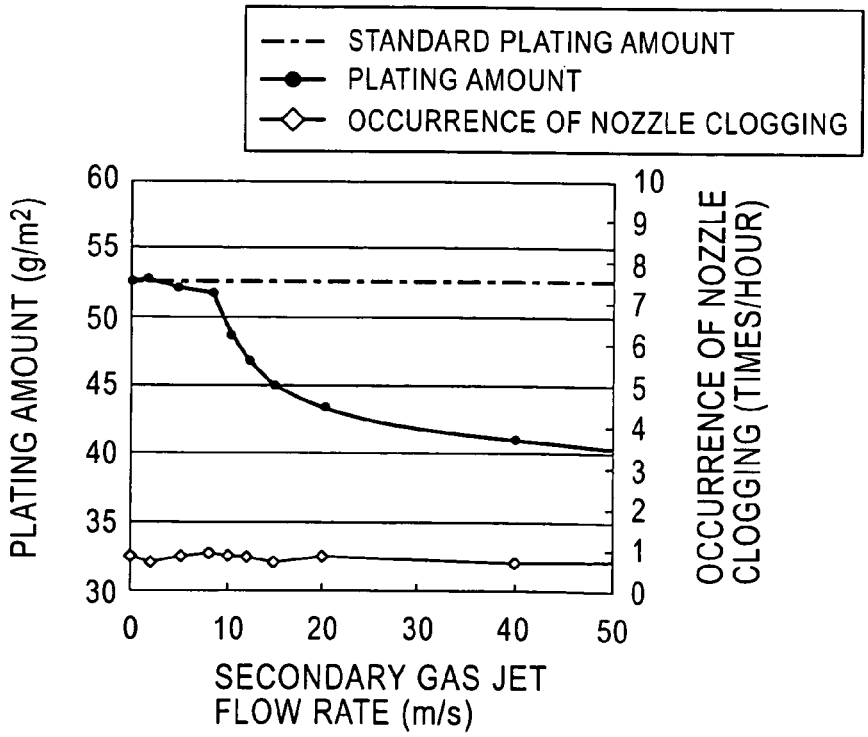
FIG. 14 is an enlarged view of a part (region having small intervals L) of the plot shown in FIG. 13.

FIG. 13 shows the relationship between the flow rate of the secondary gas jets from the secondary nozzle portions 2*a* and 2*b* at the confluence p of the secondary gas jets with the primary gas jet from the primary nozzle portion 1 and the plating amount and between the flow rate of the secondary gas jets at the confluence p and the occurrence of nozzle clogging, obtained from tests using the type of gas-wiping nozzle shown in FIG. 8 (displacement L=20 mm, thickness t of the end of the first nozzle member of the primary nozzle portion=1 mm). FIG. 14 shows part of FIG. 13 (region having small displacement L) in an enlarged view. The standard plating amount shown in FIGS. 13 and 14 refers to the plating amount when gas wiping is performed only by the gas jet discharged from the primary nozzle portion without using gas gets from the secondary nozzle portions. FIGS. 13 and 14 show that the plating amount is reduced effectively when the flow rate at the confluence p of the secondary gas jets from the secondary nozzle portions comes to 10 m/s or more, and particularly effective when it comes to 20 m/s or more.

Figure 15:
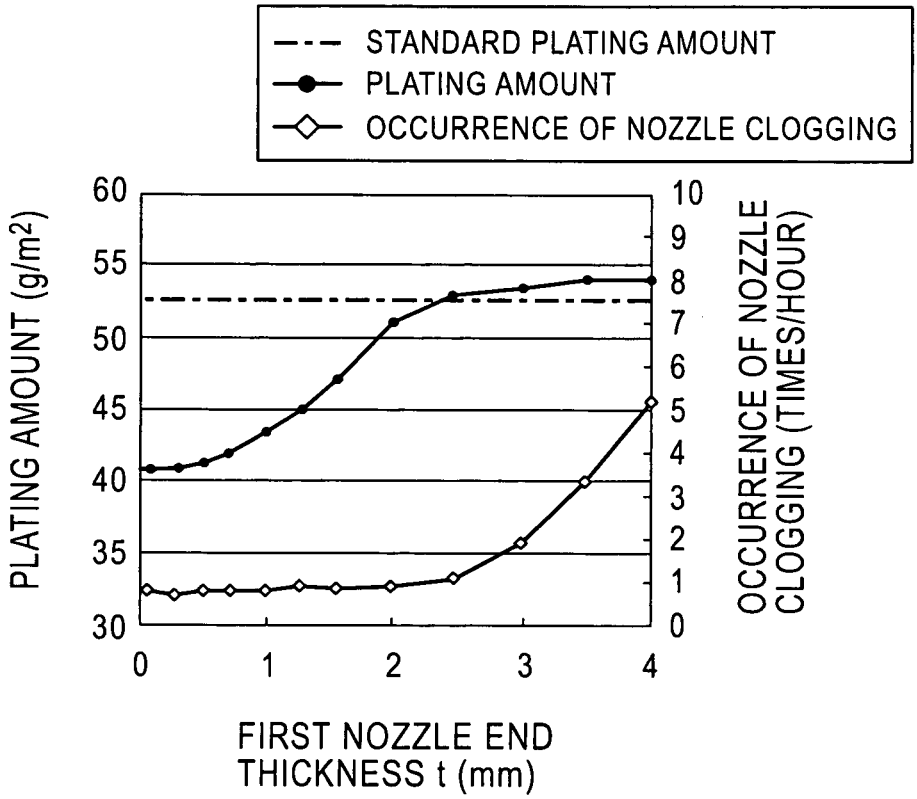
FIG. 15 is a plot showing the relationships between the thickness t of the ends of the first nozzle members defining a gas jetting port of the primary nozzle portion and the plating amount and between the thickness t and the occurrence of nozzle clogging, obtained from manufacture tests using the type of gas wiping nozzle shown in FIG. 8.

FIG. 15 shows the relationships between the thickness t of the ends of the first nozzle members 3*a* and 3*b* defining the gas jetting port 4 of the primary nozzle portion 1 and the plating amount and between the thickness t and the occurrence of nozzle clogging, obtained from tests using the type of gas wiping nozzle shown in FIG. 8 (displacement L=mm) having different thicknesses t. In the tests, the flow rate of the secondary gas jets at the confluence p with the primary gas jet from the primary nozzle portion 1 was set at 20 m/s.

FIG. 15 shows that when the first nozzle members 3*a* and 3*b* have the ends with a thickness t of 2 mm or less, the secondary gas jet from the secondary nozzle portion can produce the effect of enhancing the performance in scraping the plating, and the nozzle clogging can be prevented. When the thickness t is 1 mm or less, the plating can be scraped particularly effectively.

The invention claimed is:

1. A method for manufacturing a molten metal plated steel strip, comprising:

jetting a gas from a gas wiping nozzle onto a surface of a steel strip continuously drawn up from a molten metal plating bath to control an amount of plating on the surface of the steel strip;

wherein the gas wiping nozzle comprises a primary nozzle portion and at least one secondary nozzle portion provided at least one of above and below the primary nozzle portion;

wherein the secondary nozzle portion jets the gas in a direction tilted from a direction in which the primary nozzle portion jets the gas so that a gas jet from the secondary nozzle portion meets a gas jet from the primary nozzle portion;

wherein the secondary nozzle portion jets the gas at a lower flow rate than the primary nozzle portion;

wherein the gas wiping nozzle is positioned with respect to the steel strip such that a lower surface of a tip of the gas wiping nozzle forms an angle of 60° to 72° with respect to the steel strip;

wherein the tip of the gas wiping nozzle has a longitudinal section having an outer angle of 60° or less;

wherein the primary nozzle portion includes a first nozzle member, and the secondary nozzle portion is defined by the first nozzle member and a second nozzle member disposed outside the first nozzle member, and wherein an end of the second nozzle member defining a gas jetting port of the secondary nozzle portion has a thickness of 2 mm or less;

wherein a sum of a thickness of an end of the first nozzle member defining a gas jetting port of the primary nozzle portion, a slit width of the gas jetting port of the secondary nozzle portion, and a thickness of the end of a second nozzle member defining the gas jetting port of the secondary nozzle portion is 4 mm or less at at least one of the upper side and the lower side of the gas wiping nozzle;

wherein the gas jetting port of the secondary nozzle portion is displaced in a direction extending away from the steel strip by at least 20 mm and at most 100 mm from the gas jetting port of the primary nozzle portion; and wherein the secondary nozzle portion jets the gas so that a flow rate of the gas jet from the secondary nozzle portion is 20 m/s to 150 m/s at a confluence with the gas jet from the primary nozzle portion.

2. A method for manufacturing a molten metal plated steel strip, comprising:

jetting a gas from a gas wiping nozzle onto a surface of a steel strip continuously drawn up from a molten metal plating bath to control an amount of plating on the surface of the steel strip;

wherein the gas wiping nozzle comprises a primary nozzle portion and at least one secondary nozzle portion provided at least one of above and below the primary nozzle portion;

wherein the secondary nozzle portion jets the gas in a direction tilted from a direction in which the primary nozzle portion jets the gas so that a gas jet from the secondary nozzle portion meets a gas jet from the primary nozzle portion;

wherein the secondary nozzle portion has a gas jetting port displaced in a direction extending away from the steel strip by at least 20 mm and at most 100 mm from a gas jetting port of the primary nozzle portion; and wherein the secondary nozzle portion jets the gas so that a flow rate of the gas jet from the secondary nozzle portion is 20 m/s to 150 m/s at a confluence with the gas jet from the primary nozzle portion.

3. The method for manufacturing a molten metal plated steel strip according to claim 2, wherein the primary nozzle portion includes a first nozzle member, and the secondary nozzle portion is defined by the first nozzle member and a second nozzle member disposed outside the first nozzle member, and wherein the gas jetting port of the secondary nozzle portion jets the gas along the outer surface of the first nozzle member.

4. The method for manufacturing a molten metal plated steel strip according to claim 3, wherein an end of the first nozzle member defining the gas jetting port of the primary nozzle portion has a thickness of 2 mm or less.

5. The method for manufacturing a molten metal plated steel strip according to claim 2, wherein an end of a first nozzle member defining the gas jetting port of the primary nozzle portion has a thickness of 2 mm or less.

* * * * *

UNITED STATES PATENT AND TRADEMARK OFFICE

CERTIFICATE OF CORRECTION

PATENT NO. : 8,529,998 B2
APPLICATION NO. : 12/227206
DATED : September 10, 2013
INVENTOR(S) : Gentaro Takeda It is certified that error appears in the above-identified patent and that said Letters Patent is hereby corrected as shown below:

On the Title page:

Item (75) Inventors;

change "Genrato" to --Gentaro--.

Signed and Sealed this
Thirty-first Day of December, 2013

Margaret A. Focarino

Margaret A. Focarino
*Commissioner for Patents of the United States Patent and Trademark Office*